US007430953B2

(12) United States Patent
Bitter

(10) Patent No.: US 7,430,953 B2
(45) Date of Patent: Oct. 7, 2008

(54) LOADING IMPLEMENT AND PROCESS FOR LOADING IMPLEMENT

(75) Inventor: Marcus Bitter, Mannheim (DE)

(73) Assignee: Deere & Company, Moline, IL (US)

( * ) Notice: Subject to any disclaimer, the term of this patent is extended or adjusted under 35 U.S.C. 154(b) by 66 days.

(21) Appl. No.: 11/516,148

(22) Filed: Sep. 6, 2006

(65) Prior Publication Data

US 2007/0056280 A1 Mar. 15, 2007

(30) Foreign Application Priority Data

Sep. 13, 2005 (DE) ..... 10 2005 043 447

(51) Int. Cl.
*B66F 9/065* (2006.01)
*F15B 11/00* (2006.01)

(52) U.S. Cl. ..... 91/437

(58) Field of Classification Search ..... 91/358 R, 91/361, 437

See application file for complete search history.

(56) References Cited

U.S. PATENT DOCUMENTS 3,472,127 A * 10/1969 Scheidt ..... 91/437
5,415,076 A * 5/1995 Krone et al. ..... 91/421
6,405,633 B1 * 6/2002 Dueckinghaus et al. ..... 91/451
7,219,592 B2 * 5/2007 Nielsen et al. ..... 91/437
2004/0221714 A1 * 11/2004 Bitter et al. ..... 91/436

FOREIGN PATENT DOCUMENTS

EP 14 50 048 2/2004

* cited by examiner

*Primary Examiner*—Thomas E Lazo

(57) ABSTRACT

A loading implement and method of operating a loading implement for the adjustment of a floating condition of a boom of the loading implement. The loading implement includes a hydraulic arrangement for the lifting and lowering of the boom, a hydraulic conveying device, a hydraulic fluid tank, a hydraulic cylinder, a control implement connected to hydraulic supply lines for the control of the hydraulic cylinder, a first and a second hydraulic line connecting the hydraulic cylinder with the fluid tank and equipped with a first and a second selector valve, a lifting side load holding valve and a control unit for switching of the selector valves. In order to permit the activation of a floating condition without the boom being lowered uncontrollably, a sensor signals the position of the boom or the hydraulic cylinder to the control unit, which is configured to cause lowering of the boom and/or the switching into the floating condition as a function of the signal delivered by the sensor.

19 Claims, 3 Drawing Sheets

LOADING IMPLEMENT AND PROCESS FOR LOADING IMPLEMENT

BACKGROUND OF THE INVENTION

1. Field of the Invention

The present invention concerns a loading implement, as well as a process for loading implement, with a hydraulic arrangement for raising and lowering a boom.

2. Description of Related Technology

Loading implements are known and include, for example, wheel loaders, telescopic loaders or other construction or agricultural loaders, or even forestry vehicles, that are provided with a hydraulic arrangement for the control of a hydraulic cylinder for lifting and lowering a boom, with which a floating condition of the hydraulic cylinder can be attained. The floating condition may be advantageous if operations are to be performed with the loading implement in which the operating tool is to guide along the surface of the ground as closely as possible to the actual contour of the ground.

An example of such a hydraulic arrangement is disclosed by U.S. Published Application No. US2004/221714 A1. There a hydraulic arrangement for a telescopic loader is provided with a hydraulic cylinder for lifting and lowering a boom and in which a floating condition can be attained. Moreover the hydraulic arrangement is provided with a load holding valve arrangement, as is required for telescopic loaders, in order to protect the boom against a break in the hose or an unintended lowering. To attain a floating condition, hydraulic lines are provided that connect both chambers of a hydraulic cylinder with a hydraulic fluid tank so as to be controlled electronically. Simultaneously the security function of the load holding valve arrangement is maintained.

The disadvantage here is that an activation of the floating condition is possible even if the boom is not located in a position that is supported on the ground. In such a case, the boom would be lowered without any control since the lifting side of the hydraulic cylinder is connected with the hydraulic fluid tank in the floating condition and could possibly inflict damage or sustain damage itself.

The problem underlying the invention is seen in the need to create a loading implement with a hydraulic arrangement for a boom, in which the floating condition can be activated without the boom being lowered uncontrollably.

SUMMARY

In view of the above and other limitations and disadvantages of the present application, a loading implement of the type cited above is provided hereby with the hydraulic arrangement including at least one hydraulic conveying device, one hydraulic fluid tank, one hydraulic cylinder with a lifting side and a lowering side hydraulic supply line, a control implement connected with the hydraulic supply line for the control of the hydraulic cylinder, a first hydraulic tank connecting the hydraulic cylinder on the lowering side with the hydraulic tank and equipped with a first selector valve, a second hydraulic line connecting the hydraulic cylinder on the lowering side with the hydraulic tank or the lowering side supply line and equipped with a second selector valve, a load holding valve arrangement on the lifting side and a control unit for the switching of the selector valves. Upon activation devices being switched to initiate the floating condition for the hydraulic cylinder, sensor signals at least one position of the boom or of the hydraulic cylinder, a control unit controls lowering of the boom and/or the switching into the floating condition as a function of a signal delivered by the sensor. More specifically, after the activation of the floating condition by the activating devices, the system first determines whether the boom is in a raised position. This determination is based on the detection and processing of the sensor signal regarding the position of the boom. If the sensor signals that the boom is in a raised position, then the control devices for the lowering of the boom, as well as the selector valves, are controlled correspondingly by the control unit until the boom is preferably in its completely lowered position. Only then does the control unit perform a switching and/or control of the corresponding components of the hydraulic arrangement into the floating condition for the hydraulic cylinder or the boom. However, if the control unit determines (after the activation for switching into a floating condition) that the boom is located in its preferably completely lowered position or location, which is signaled by a corresponding sensor signal, then the control unit performs the corresponding switching and/or control of the corresponding components of the hydraulic arrangement into a floating condition for the hydraulic cylinder or the boom directly, that is, without the performance of a controlled lowering process of the boom. Thus, the present system provides assurances that then the floating condition is activated, the boom is in a lowered position before the corresponding switching or control processes for a floating condition are initiated.

The hydraulic line connecting the hydraulic cylinder on its lowering side with the hydraulic fluid tank preferably leads directly ahead of the first selector valve to the hydraulic fluid tank. It is, however, also conceivable that the connection be established over the control implement, so that the hydraulic line is connected with the supply line on the lifting side, in particular, between the load holding valve arrangement and the control implement. In this case the selector valve in its neutral position establishes the connection to the tank on the lifting side, while the load on the hydraulic cylinder continues to be held by the load holding valve arrangement. In order to switch the control implement into the lifting position, the first selector valve is brought into a closed position so that the connection to the rod side of the hydraulic cylinder is interrupted.

In one preferred embodiment, the controllable control devices for the lowering of the boom include a pressure limiting arrangement, where preferably a manually switched control implement can be applied to the hydraulic arrangement. However, the control implement can be configured so as to be switched electrically or hydraulically. Such a pressure limiting arrangement can be configured as a controllable pressure limiting valve position into an open position preferably proportionally controlled. Here, a hydraulic flow is preferably interrupted in the closed position, but an unimpeded hydraulic flow is permitted in a fully open position. Corresponding intermediate positions (not fully open positions) permit a throttled hydraulic flow. Thus, a volume flow that is permitted to pass through the pressure limiting valve can be controlled or regulated in a manner proportional to a control signal. Here it is also possible to apply a correspondingly configured throttling valve in which the flow cross section can be controlled or regulated in proportion to a control signal. Other types of valves or arrangements are also conceivable in which the volume flow can be controlled as a function of a control signal.

Preferably the controllable pressure limiting arrangement is arranged in such a way that when the first and second selector valves are opened, a hydraulic fluid flow on the lifting side can be regulated or controlled. Here the positioning of the pressure limiting arrangement between the lifting side of the hydraulic cylinder and the hydraulic fluid tank is significant, that is, the pressure limiting arrangement can be arranged between the lifting side of the hydraulic cylinder and the first or second selector valve, as well as between the first and the second selector valve and hydraulic fluid tank, so that when the selector valves are opened the drainage flow from the lifting side of the hydraulic cylinder to the hydraulic fluid tank can be controlled, regulated or adjusted. At the beginning of the lowering process for the boom, the pressure limiting arrangement is supplied with a corresponding closing control value in which the pressure limiting arrangement is closed or is nearly closed. After a corresponding closing pressure value has been adjusted, both selector valves are opened. Immediately following, a control process for the pressure limiting arrangement is initiated, so that the pressure limiting arrangement opens slowly. In a pressure limiting arrangement configured as a pressure limiting valve, if the pressure limiting value provided as input or the adjusted pressure or the control pressure is lower than the pressure in the lifting chamber of the hydraulic cylinder, then the boom begins a lowering process. This lowering can be detected and evaluated by the sensor measuring a change in the position or the location of the boom, so that the pressure limiting arrangement can be controlled in such a way that a certain lowering velocity is not exceeded. Thereby an independence of the loaded condition of the boom is attained. If the boom is not lowered any further, the assumption can be made that the boom is resting on the ground. After the determination that the boom has been lowered completely, a corresponding pressure control value can be provided as input for the pressure limiting arrangement at which the pressure limiting arrangement is opened completely or almost completely. Since now the pressure limiting arrangement as well as the selector valves are opened, the boom can move freely or in a floating mode, whereby an unimpeded hydraulic flow can take place between the hydraulic cylinder and the hydraulic fluid tank. In a pressure limiting arrangement configured as a throttling valve in place of the pressure limiting valve, a corresponding flow cross section is controlled in proportion to the flow cross section between a closed and a fully opened condition. As an additional safety measure, it is conceivable that a monitoring of the velocity be provided during the floating condition process which prevents the boom from exceeding a certain velocity. If the boom is lowered to rapidly, the pressure limiting arrangement can be closed so that a certain maximum allowable velocity is not exceeded. In addition the maximum allowable velocity can be limited in proportion to the length of the extension of the lifting cylinder in order, for example, to limit the lowering of the boom from high operating heights, in comparison to the lowering at lower operating heights, with respect to the lowering velocity.

In another embodiment, the controllable control devices for the lowering of the boom include a proportional control of the control implement. In such a control of the control implement, a separate pressure limiting arrangement can be omitted. If, after activation of the floating condition, the control implement determines that the boom is not in a lowered position (this determination can be performed in the manner described above), the control implement is directly or indirectly controlled automatically by the control unit and brought into a lowering position, while the selector valves are closed. Thus the hydraulic cylinder is emptied in the usual way over the existing load holding valve arrangement so that the boom is lowered. Here, the lowering is detected as a change in the position of the boom by various measuring technologies and utilized by the control unit in such a way that the control or regulation of the control implement does not permit the lowering velocity to be less than a predetermined velocity. This can be supported by pressure scales in the control implement that correspond to the state of the art and are usually applied, in order to maintain the volume flow of a control implement at a constant level, independently of the load and independently of the pump rotational speed. Thereby the system becomes independent of the loading condition of the boom. If the boom can not be lowered any further, it can be assumed that the boom is resting on the ground and the control implement is shifted into its neutral position. Immediately following or simultaneously, the two selector valves are opened so that a floating condition is attained.

The control of the control implement may be a purely electrical control or a pneumatic or hydraulic control, where the control signals for the lowering of the boom are limited to an appropriate value in order to limit the lowering velocity to a corresponding value. Moreover, as an additional safety measure it is conceivable that an additional monitoring of the velocity be provided during the floating condition so as to prevent the boom from exceeding a certain velocity during the lowering process. If the boom is lowered too rapidly, the selector valves can be closed and the lowering process can again be actively performed by the control implement. In addition, the maximum allowable velocity can here be limited in proportion to the length of the extension of the lifting cylinder.

Preferably the sensor indicating or signaling the boom position is configured as a position sensor or an angle sensor, so that the position or location of the boom or the hydraulic cylinder can be measured directly. The position sensor may, for example, be connected directly with the lift of the piston rod of the hydraulic cylinder or take up or detect or monitor another variable distance that is connected to the hydraulic cylinder or the boom. An angle sensor may, for example, be arranged at the pivot points of the boom or at the hydraulic cylinder and take up or detect or monitor a corresponding pivot angle.

Alternatively, in place of the position sensor or angle sensor, a pressure sensor could also be applied, where at least one position of the boom or the hydraulic cylinder can be signaled as a function of the pressure. Thereby the position or the location of the boom is not measured or determined directly, but instead the pressure on the lifting side of the lifting cylinder is measured or determined from which a conclusion regarding the position of the boom is possible. Here the lowering of the boom is performed not by controlling a pressure limiting arrangement upward, but by a direct control of the control implement to lower the boom initiated by the control unit. Thereby a pressure limiting arrangement can be omitted. If the boom rests on the ground the pressure on the lifting side of the lifting cylinder is reduced, since that cylinder is no longer required to carry the load of the boom. The drop-off of the pressure provides a signal or indirectly provides a position or a location of the boom, whereby the lowering of the pressure below a predetermined value (preferably the least possible pressure to support an unloaded boom) can provide an indirect indication of the lowered position or location of the boom. As long as the pressure has not dropped off to the predetermined value, the control unit assumes that the boom is not in a lowered position. Only when the particular pressure has been reached or the system is below that pressure, then an opening of the two selector valves is initiated by the control unit in order to attain a floating condition. Obviously the pressure sensor can also be replaced by a pressure switch.

The activation devices for the activation of the floating condition may, for example, be configured as switches with which an activation signal can be transmitted to the control unit. Such switches are preferably accommodated, for example, in the cab of a loading implement or on the operating console. Moreover the activation devices may also be configured as a joystick or integrated into the positions of a joystick, so that the joystick is configured with an integrated floating condition that is detected electronically.

The selector valves are preferably configured as electrically actuated selector valves, where here pneumatically or hydraulically actuated selector valves can also be applied.

These and other aspects and advantages of the present invention will become apparent upon reading the following detailed description of the invention in combination with the accompanying drawings.

BRIEF DESCRIPTION OF THE DRAWINGS

The drawing shows several embodiments incorporating the principles of the invention, on the basis of which the invention as well as further advantages, advantageous further developments and embodiments of the invention shall be explained and described in greater detail in the following, in which.

DETAILED DESCRIPTION

Figure 1:
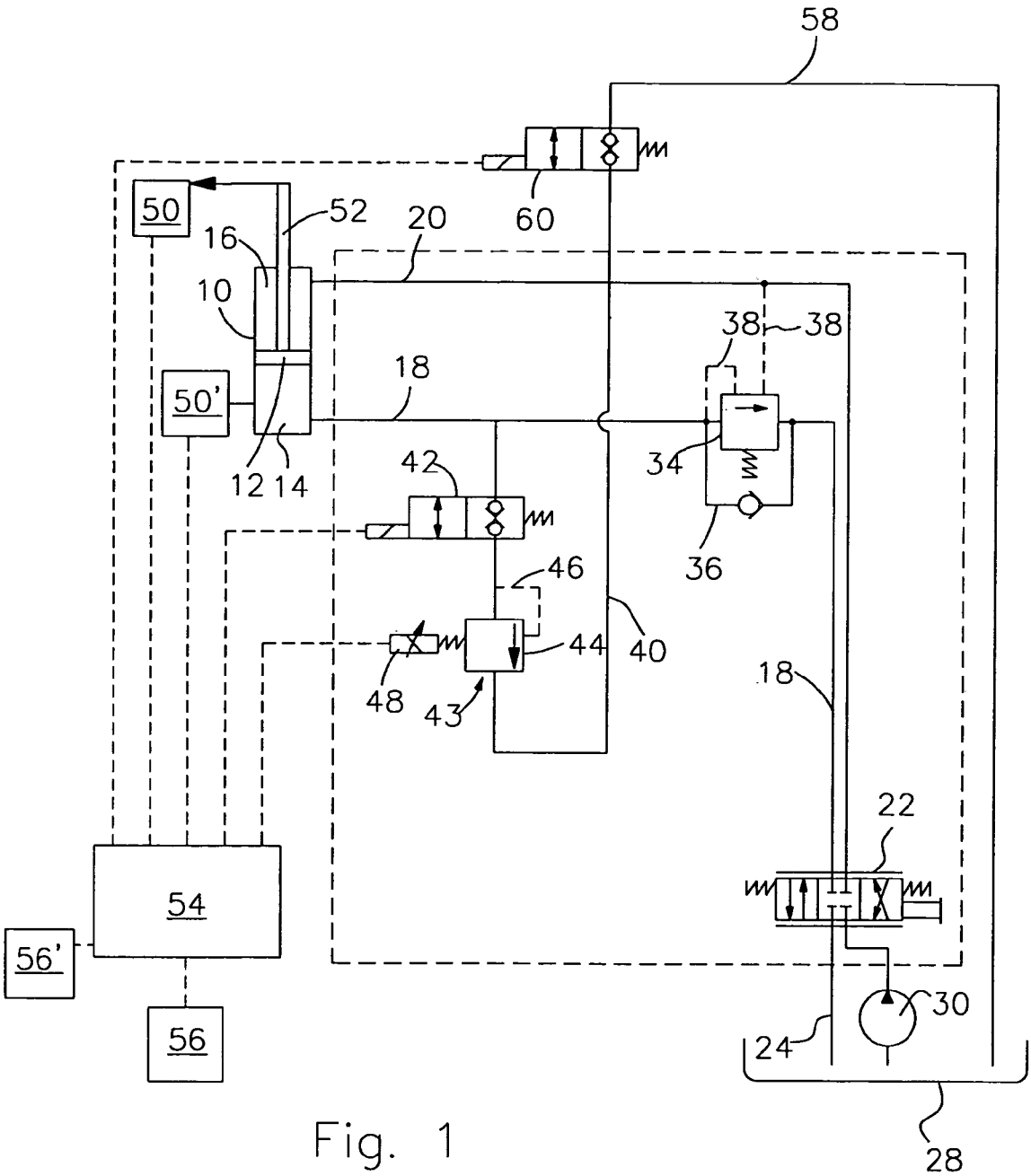
FIG. 1 shows a schematic hydraulic circuit arrangement of a hydraulic arrangement with a floating condition and a semi-active spring support function.

FIG. 1 shows an example of a hydraulic arrangement for a semi-active spring support assembly for a boom, where in addition to a spring support function, a floating condition is also provided. FIG. 1 shows a hydraulic cylinder 10 with a hydraulic piston 12 that is used for lifting and lowering a boom 70 of a loading implement 61 (the latter two of which are both shown in FIG. 3). The hydraulic cylinder 10 is provided with a lifting side chamber 14 and a lowering side chamber 16. The lifting side chamber 14 is connected over a lifting side hydraulic line 18 and the lowering side chamber 16 is connected over a lowering side hydraulic line 20, both to a manually actuated control implement 22. The control implement 22 may also be actuated electrically or hydraulically.

The control implement 22 is connected with a hydraulic fluid tank 28 over a hydraulic drain line 24. A hydraulic pump 30 conveys hydraulic fluid into each of the hydraulic lines 18, 20 over the control implement 22.

The control implement 22 can be shifted into three positions, into a closed position in which no flow takes place in both hydraulic lines 18, 20; in a lifting position, in which the lifting side hydraulic line 18 is supplied with hydraulic fluid, while the lowering side hydraulic line 20 drains hydraulic fluid to the hydraulic fluid tank 28; and a lowering position in which the lowering side hydraulic line 20 is supplied with hydraulic fluid, while the lifting side hydraulic line 18 drains hydraulic fluid to the hydraulic fluid tank 28.

The lifting side hydraulic line 18 contains a load holding valve 34 that permits a flow of hydraulic fluid in the direction of the hydraulic cylinder 10 over a bypass line 36. The load holding valve 34 can be opened in the direction of the hydraulic fluid tank 28 over control lines 38, so that a flow of hydraulic fluid can take place to the hydraulic fluid tank 28.

A connecting line 40 is arranged between the lifting side and the lowering side hydraulic lines 18, 20. The connecting line 40 contains an electrically controlled selector valve 42. The selector valve 42 has a blocking position in which no flow takes place in both directions and an open position in which a through flow is possible in both directions. Furthermore the connecting line 40 contains a controllable pressure limiting arrangement 43 with a controllable pressure limiting valve 44 that opens in the direction of the lowering side hydraulic line 20 over a control line 46. The control pressure or the pressure threshold value to open the pressure limiting valve 44 can be controlled by a controller 48 in the pressure limiting arrangement 43. In place of the pressure limiting valve 44, the application of a controllable throttle or orifice is also possible.

Moreover, a position sensor 50 is connected to a piston rod 52 of the hydraulic cylinder 10 and delivers a sensor signal reproducing the position of the hydraulic piston 12 to a control unit 54. The control unit 54 is connected to a switching arrangement 56, by means of which the control unit 54, and therewith the hydraulic spring support system, can be activated.

Furthermore a second lowering side hydraulic line 58 is provided that leads from the first lowering side hydraulic line 20 to the hydraulic fluid tank 28 and is equipped with a further selector valve 60, which may be configured identically to the selector valves 42.

An activation switch 56' is provided for the activation of a floating condition and is connected to the control unit 54.

According to FIG. 1 the hydraulic semi-active spring support system is configured as a demand controlled spring support system in which, on demand, a volume flow flows from the control implement 22 to the hydraulic cylinder 10 of the boom 70 over the load holding valve 34. The control implement 22 is located in the closed position and is switched on demand by the control unit 54 into the corresponding other positions.

If the control for the semi-active spring support system is activated by the switching arrangement 56, then the original position of the boom 70 is retained as a guide magnitude that must be maintained (target value). The control unit 54 determines from this guide magnitude and the actual measured position (control magnitude) the deviation (control difference) from each other, in order to perform the control of the pressure limiting valve 44 on this basis and to adjust the value of the volume flow from the control implement 22 by means of further adjustment magnitudes.

In order for the hydraulic piston 12 of the hydraulic cylinder 10 to move on the basis of disturbance magnitudes acting upon it, the selector valves 42, 60 must be switched into their open positions.

The pressure that is to be applied to the lifting side of the hydraulic cylinder 10 is controlled according to demand by the control unit 54 by means of the electrically controlled pressure limiting valve 44.

If the control unit 54 determines that the boom 70 has been lowered too far, the pressure limiting valve 44 is adjusted to a higher value and the control implement 22 is opened, so that the pressure on the lifting side of the hydraulic cylinder 10 is increased by the flowing volume flow and the hydraulic cylinder 10 is extended.

If the control unit 54 determines that the boom 70 has been raised too high, the pressure limiting valve 44 is adjusted to a lower pressure, so that the pressure on the lifting side of the hydraulic cylinder 10 is reduced and the hydraulic piston 12 is retracted. The hydraulic fluid that then flows from the lifting side of the hydraulic cylinder 10 over the pressure limiting valve 44 and the first selector valve 42 to the lowering side of the hydraulic cylinder 10, flows from that location to the hydraulic fluid tank 28 over the second selector valve 60.

Upon a bump that permits the hydraulic piston 12 to retract, the hydraulic fluid is displaced from the lifting side of the hydraulic cylinder 10 by the hydraulic piston 12 and drains off over the pressure limiting valve 44 and over the selector valves 42,60. On the basis of the volume of the displaced hydraulic fluid the boom 70 is lowered, that in turn is recognized by the control unit 54 as a control difference, whereupon the control unit 54 increases the opening pressure of the pressure limiting valve 44 and brings the control implement 22 into the lifting position, so that a volume flow flows to the lifting side of the hydraulic cylinder 10, whereby the adjusting magnitudes are determined by the control unit 54 in accordance with the control difference. On the basis of the increase in the opening pressure and the volume flow flowing from the control implement 22, the boom 70 is again raised until the control difference is again reduced to zero or to a predetermined threshold value.

Upon a bump that permits the hydraulic cylinder 10 to extend, the load on the hydraulic fluid on the lifting side is reduced by the movement of the hydraulic piston 12 and a volume increase of the lifting side chamber 14 takes place, since hydraulic fluid is displaced from the lowering side chamber 16 to the hydraulic fluid tank 28. This raising of the boom 70 is recognized by the control unit 54 as control difference and the control implement 22 is brought into the lifting position in order to fill the developing volume on the lifting side of the hydraulic cylinder 10 by means of a volume flow. On the basis of the added volume of hydraulic fluid, the boom 70 remains in the raised position, which is recognized by the control unit 54 as before as a control difference, whereupon the control unit 54 reduces the opening pressure of the pressure limiting valve 44, in that the control unit 54 determines the adjustment magnitudes according to the control difference. Beyond that, the control unit 54 again switches the control implement 22 into the closed position. Due to the reduction of the opening pressure hydraulic fluid drains from the lifting side of the hydraulic cylinder 10 over the pressure limiting valve 44 and the boom 70 is lowered, until the control difference has been reduced to zero or to a predetermined threshold value.

If now a floating condition is activated by actuating the activation switch 56', while the spring support function is activated, then a spring support mode is interrupted by the control unit 54. The interruption of the spring support mode is immediately followed by the detection of the position or the location of the boom 70 or the hydraulic cylinder 10 by the sensor 50, which delivers a corresponding sensor signal to the control unit 54. If the boom 70 should not be located in a completely lowered position, the pressure limiting valve 44 is slowly controlled upward starting from a low pressure limiting value or controlled downward to the lowest pressure limiting values, so that the boom 70 begins to descend. Thereby the hydraulic fluid flowing out of the lifting side chamber 14 can flow into the hydraulic fluid tank 28 over the open selector valves 42, 60. Moreover the position or location of the boom 70 is simultaneously registered over the sensor signal by the control unit 54. As soon as a completely lowered position has been reached, the pressure limiting valve 44 is fully opened, so that a floating condition for the boom 70 is adjusted through the opened selector valves 42, 60. The control unit can again be switched into a spring support mode by renewed actuation of the activation switch 56' (deactivation).

If the floating condition is to be activated when the spring support function is deactivated, then a lowering of the boom 70 is also performed in the same manner, with the sole difference being that the control unit 54 opens the selector valves 42, 60 from a closed position at the same instant as the upward control of the pressure limiting valve 44.

The control implement 22 shown in FIG. 1 and the selector valves 42, 60 are shown as switched electrically. They may, however, also be controlled pneumatically, hydraulically or in some other manner.

In place of the position sensor 50, a pressure sensor 50' could also be applied. The pressure sensor 50' is arranged so as to conduct pressure and is connected to the lifting side chamber 14. Here, the basis is assumed that the pressure is at a minimum when the boom 70 is lowered. Here the boom 70 is brought into its lowered position by the control implement 22 which is brought into its lowering position initiated by the electrical control unit 54. Here a pressure limiting arrangement 43 is not applied. If this minimum pressure value is signaled by the pressure sensor 50', then the system assumes that the boom 70 is in its lowered position or location. If the sensor 50' signals a pressure that deviates from the previously established minimum value, then the system assumes that the boom 70 must be lowered. The pressure sensor 50' thereby permits a conclusion as to the position or location in which the boom 70 is located at that time. Corresponding to the pressure values signaled by the pressure sensor 50', the control unit 54 performs a previously established control procedure in which the pressure limiting valve 44 is slowly controlled upward or the boom 70 is slowly lowered, that is, when the pressure value drops the pressure limiting valve 44 is controlled upward correspondingly so that when a predetermined minimum pressure value is reached, a corresponding signal transmitted by the pressure sensor 50' is assumed by the control unit 54 to be a signal for the complete opening of the pressure limiting valve 44.

Figure 2:
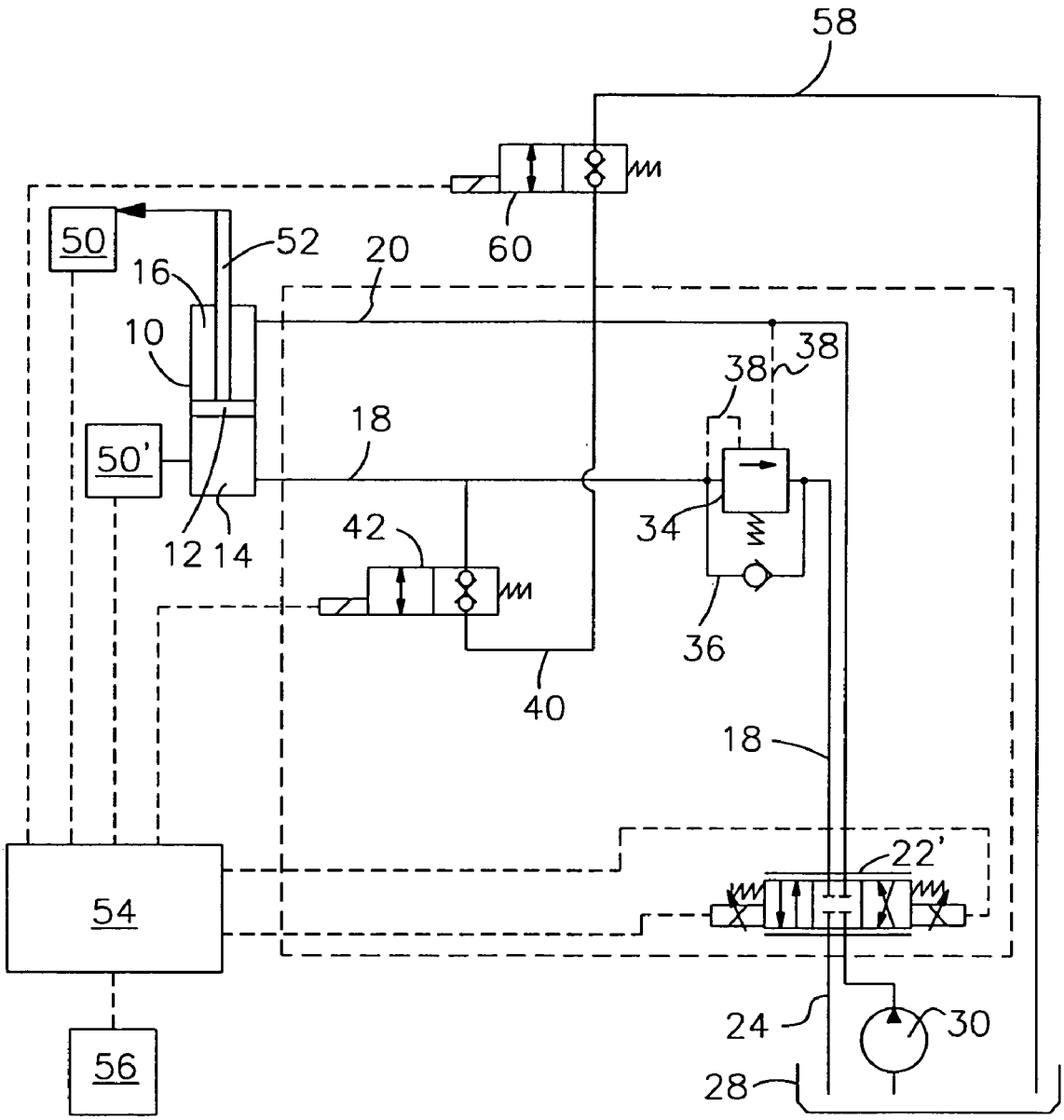
FIG. 2 shows a schematic hydraulic circuit arrangement of a hydraulic arrangement with a floating condition without a semi-active spring support function.

FIG. 2 shows a further hydraulic arrangement with a floating condition function and without a spring support function. The hydraulic arrangement shown in FIG. 2 differs from that described above for FIG. 1 on the one hand in that no pressure limiting arrangement 43 is provided in the connecting line 40 with which the spring support function has been realized in the embodiment according to FIG. 1, and on the other hand in the fact that a controllable control implement 22', controlled by the control unit 54, is arranged in place of the controllable control implement 22. Beyond that the activation switch 56 arranged in FIG. 1 for the activation of the spring support function can here be used for the activation of the floating condition. No further differences from the hydraulic arrangement of FIG. 1 are seen.

The arrangement of the method of operation of the hydraulic arrangement of FIG. 2 remains generally the same with regard to the lifting, lowering and holding of the hydraulic cylinder 10 as it was for FIG. 1, except for the fact that the control of the control implement 22' is performed by the control unit 54. Switching into the floating condition by opening the two selector valves 42, 60 is also performed in the same manner, except that in the embodiment shown in FIG. 2 the lowering of the boom is performed by a corresponding control of the control implement 22', as explained in greater detail below.

If in the embodiment shown in FIG. 2 a floating condition is activated by actuation of the activation switch 56, then a detection of the position or the location of the boom 70 or the hydraulic cylinder 10 by the sensor 50 follows simultaneously. The sensor 50 transmits a corresponding sensor signal to the control unit 54 and the selector valves 42, 60 are closed. If the boom 70 is not in a completely lowered position, then the control implement 22' is actuated by the control unit 54 and brought into the lowering position. There, an adjustable regulating procedure provides that a predetermined lowering velocity is not exceeded. This is attained by the fact that the proportionally controlled control implement 22' permits only one predetermined volume flow. As soon as the lowering position is adjusted on the control implement 22' the hydraulic fluid can flow into the hydraulic fluid tank 28 from the first chamber 14 of the hydraulic cylinder 10 to the load holding valve 34, and the boom 70 can be lowered. Simultaneously the position or location of the boom 70 is registered over the sensor signal. As soon as a completely lowered position has been reached, the control implement 22' is brought into the neutral position and simultaneously the selector valves 42, 60 are opened so that a floating condition for the boom 70 is adjusted. The floating condition can be deactivated by a renewed actuation of the activation switch 56 (deactivation) so that the selector valves 42, 60 are again closed and the hydraulic arrangement can be operated in a normal operating mode.

The control implement 22' shown in FIG. 2 and the selector valves 42, 60 are shown as being operated electrically. Obviously, they may alternatively be controlled pneumatically, hydraulically or in any other manner.

A pressure sensor 50' can also be applied to the configuration of FIG. 2 in place of the position sensor 50, corresponding configurations for FIG. 1.

Figure 3:
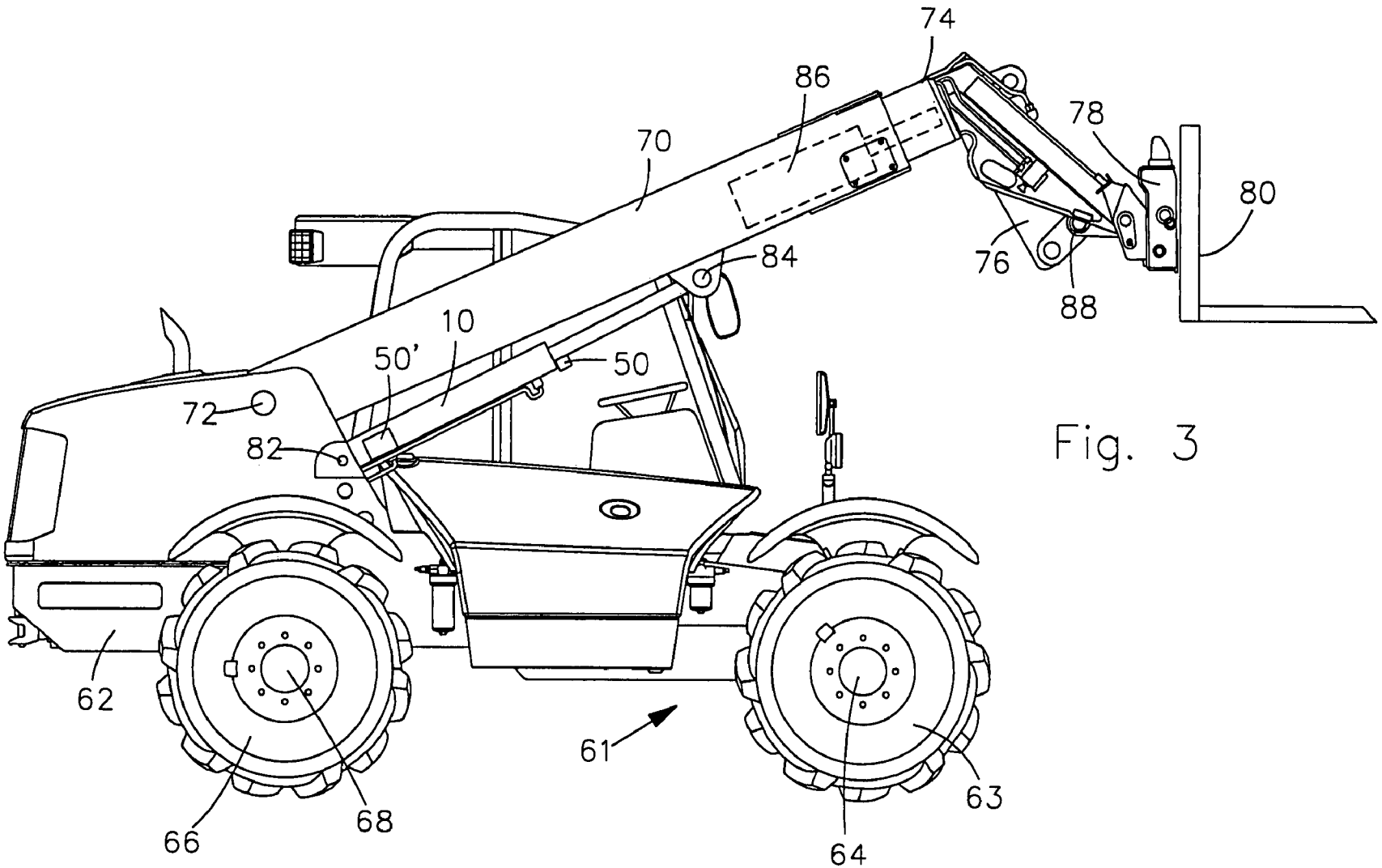
FIG. 3 shows a schematic side view of a loading implement with a hydraulic arrangement according to FIGS. 1 or 2 and embodying the principles of the present invention.

FIG. 3 shows a loading implement 61 in the form of a telescopic loader that can utilize a hydraulic arrangement according to FIGS. 1 or 2. The loading implement 61 is provided with a frame 62 that is carried by a front axle 64 equipped with front drive wheels 63 and a rear axle 68 equipped with rear drive wheels 66.

The loading implement 61 is provided with a boom 70 that is connected in joints to the frame 62 by means of a pivot axis 72 extending parallel to the drive axles 64, 68.

The boom 70 is configured as a telescopic boom and is provided with an operating head 76 at its free end 74 with which a loading tool 80 can be taken up by means of a tool holder 78, which is free to pivot about the operating head 76. The boom 70 can be extended and retracted telescopically by means of adjusting cylinders (not shown) within the boom 70. The boom 70 can be pivoted by means of the hydraulic cylinder 10. The hydraulic cylinder 10 is connected to the frame 62 at its first end, preferably on the piston side, free to pivot about a pivot axis 82 and is connected at its second end to the boom 70, free to pivot about a pivot axis 84. Moreover a further hydraulic cylinder 86 is arranged in the interior of the boom 70 at the region of the free end. The hydraulic cylinder 86 is used as a tilting cylinder for the tool holder 78 and is connected in joints, free to pivot, at the operating head 76, where the tool holder 78 can be pivoted by a tilting linkage 88 connected to the hydraulic cylinder 86.

The hydraulic cylinder 10 arranged for the pivoting of the boom 70 is provided on its lifting side with a pressure sensor 50', by means of which the pressure predominating in the lifting side of the hydraulic cylinder 10 can be detected. Additionally or alternatively, the hydraulic cylinder 10 is provided on its rod end side with a position sensor 50 by means of which the position of the extension of the hydraulic cylinder 10 can be detected. The pivoted position (pivot angle) of the boom 70 can be determined by means of the position of the extension of the position sensor 50. Alternatively a position sensor configured as an angle of rotation transmitter (not shown) can also be arranged at the pivot axis 72 of the boom 70, in order to detect the pivoted position of the boom 70.

It is therefore intended that the foregoing detailed description be regarded as illustrative rather than limiting, and that it be understood that it is the following claims, including all equivalents, that are intended to define the spirit and scope of this invention.

The invention claimed is:

1. A loading implement with hydraulic arrangement for lifting and lowering a boom, the hydraulic arrangement comprising:

at least one hydraulic conveying device;

a hydraulic fluid tank;

a hydraulic cylinder with a lifting side hydraulic supply line and a lowering side hydraulic supply line;

a control implement connected to the lifting and lowering lines for the control of the hydraulic cylinder;

a first hydraulic line connecting the hydraulic cylinder on the lowering side with the hydraulic fluid tank and equipped with a first selector valve;

a second hydraulic line connecting the hydraulic cylinder on the lifting side with the hydraulic fluid tank or with the lowering side supply line and equipped with a second selector valve;

a lifting side load holding valve arrangement and a control unit for the switching of the selector valves;

a sensor adapted to signal at least one position of the boom or the hydraulic cylinder;

activation devices for shifting into a floating condition for the hydraulic cylinder; and controllable control devices for the lowering of the boom, wherein the control unit is configured in such a way that the lowering of the boom and/or the shifting into the floating condition takes place as a function of the signal delivered by the sensor.

2. The loading implement according to claim 1, wherein the first hydraulic line is connected with the hydraulic fluid tank by one of directly or over the control implement.

3. The loading implement according to claim 1, wherein the controllable control devices for the lowering of the boom include a controllable pressure limiting arrangement.

4. The loading implement according to claim 3, wherein the controllable limiting arrangement is one of a throttle and a pressure limiting valve.

5. The loading implement according to claim 3, wherein the controllable pressure limiting arrangement is arranged such that when the first and second selector valves are opened a flow of hydraulic fluid can be regulated or controlled.

6. The loading implement according to claim 1, wherein the controllable control devices for the lowering of the boom include a proportionally controllable control of the control implement.

7. The loading implement according to claim 1, wherein the sensor is a one of a position sensor and an angle sensor.

8. The loading implement according to claim 1, wherein the sensor is a pressure sensor whereby at least one position of the boom or the hydraulic cylinder can be signaled as a function of the pressure.

9. The loading implement according to claim 1, wherein the activation devices are one of switches and a joystick.

10. A process for the adjustment of a floating condition of a loading implement, where the loading implement includes a hydraulic arrangement, at least one hydraulic conveying device, a hydraulic fluid tank, a hydraulic cylinder with a lifting side and a lowering side supply line, a control implement connected with the supply line, a control implement connected with the supply lines for the control of the hydraulic cylinder, a first hydraulic line connecting the hydraulic cylinder on the lowering side with the hydraulic fluid tank and equipped with a first selector valve, a second hydraulic line connecting the hydraulic cylinder on the lifting side with the hydraulic fluid tank or with the lowering side supply line and equipped with a second selector valve, a lowering side load holding valve arrangement and a control unit for the control of the selector valves, the process comprising the steps of:

signaling by means of a sensor at least one position of the boom or the hydraulic cylinder, controllably bringing the boom into a lowered position as a function of a signal delivered by the sensor by means of the control unit, and after an activation by activation devices, before and thereafter switching the selector valves into a position representing a floating condition for the hydraulic cylinder.

11. The process according to claim 10 further comprising the step of moving an actuation device to initiate the floating condition.

12. The process according to claim 10, wherein the first hydraulic line is connected with the hydraulic fluid tank directly to or over the control implement.

13. The process according to claim 10, wherein the step of bringing the boom into a lowered position is performed by means of a pressure limiting arrangement that can be controlled by the control unit.

14. The process according to claim 13, wherein the pressure limiting arrangement is one of a pressure limiting valve and a throttle.

15. The process according to claim 10 further comprising the step of, when the first and the second selector valves are opened, regulating a lifting side flow of hydraulic fluid tank.

16. The process according to claim 10, wherein the step of bringing the boom into a lowered position is performed by means of a proportionally controlled control of the control implement by the control unit.

17. The process according to claim 10, wherein the sensor is one of a position sensor and an angle sensor.

18. The process according to claim 10 further comprising the step of signaling at least one position of the boom or hydraulic cylinder as a function of pressure.

19. The process according to claim 11, wherein the activation device is configured as at least one of a switch and a joystick.

* * * * *